United States Patent [19]

Hirose et al.

[11] Patent Number: 4,943,272

[45] Date of Patent: Jul. 24, 1990

[54] APPARATUS FOR MANUFACTURING CIGARETTE FILTER

[75] Inventors: Ichiro Hirose, Tokyo; Katsuo Kato; Motonori Inamura, both of Hiratsuka, all of Japan

[73] Assignee: Japan Tobacco Inc., Tokyo, Japan

[21] Appl. No.: 312,187

[22] Filed: Feb. 21, 1989

[30] Foreign Application Priority Data

Nov. 18, 1987 [JP] Japan ..... 62-289538

[51] Int. Cl.[5] ..... A24C 5/28

[52] U.S. Cl. ..... 493/45; 493/44; 493/48; 131/94; 131/282

[58] Field of Search ..... 493/44–48; 131/94, 282

[56] References Cited

U.S. PATENT DOCUMENTS 3,158,251 11/1964 Skala et al. ..... 131/94

FOREIGN PATENT DOCUMENTS 1130752 10/1968 United Kingdom ..... 131/94

1226136 3/1971 United Kingdom ..... 131/94

*Primary Examiner*—Frederick R. Schmidt

*Assistant Examiner*—Jack Lavinder

*Attorney, Agent, or Firm*—Nixon & Vanderhye

[57] ABSTRACT

A filter-manufacturing apparatus comprises a cutting drum, which has transporting grooves and adapted to receive filter rods having a prescribed length. An annular slit is formed in the circumference of the cutting drum. A circular cutting blade extends into the annular slit in a rotatable manner. A rod-shaped stopper is movably arranged in each transporting groove, and the distance between each stopper and the annular slit is adjustable such that it corresponds to the length of a filter plug to be cut from a filter rod. The cutting drum comprises a pushing mechanism for moving the filter rod along the transporting groove against the stopper by jetting air, whereby the filter rod is cut by the cutting blade, with its one and abutting against the stopper. A receiving drum with receiving grooves is in rolling contact with the cutting drum. The receiving drum rotates such that the receiving grooves come into alignment with the transporting grooves of the cutting drum. The receiving drum is provided with a transfer mechanism. This transfer mechanism sucks only the filter plug cut from the filter rod held in the transporting groove and transfers it into the receiving groove. The transfer mechanism causes the remaining part of the filter rod to be held in the transporting groove, in order for the remaining part to be carried again to the cutting blade with the rotation of the cutting drum.

7 Claims, 11 Drawing Sheets

APPARATUS FOR MANUFACTURING CIGARETTE FILTER

BACKGROUND OF THE INVENTION

1. Field of the Invention

The present invention relates to a cigarette filter-manufacturing apparatus to be incorporated in equipment for manufacturing filter-tipped cigarettes, and more particularly to a cigarette filter-manufacturing apparatus capable of producing cigarette filters of various sizes.

2. Description of the Related Art

A cigarette filter-manufacturing apparatus of this type comprises a hopper for storing a large number of filter rods having a predetermined length. The filter rods are supplied one by one from the hopper to a cutting drum. This cutting drum has a number of filter rod-transporting grooves formed in the circumference thereof at regular intervals, and the transporting grooves has a size suitable for receiving the filter rods. A filter rod supplied from the hopper are received in a transporting groove of the cutting drum, and is transported as the cutting drum rotates.

One or more one annular slits are formed in the circumference of the cutting drum such that they extend across the filter rod-transporting grooves. The annular slits are located at such positions that the filter rod in each transporting groove can be divided in equal parts. One or more circular cutting blades, the number of which is equal to that of annular slits, are arranged in the vicinity of the circumference of the cutting drum. Each cutting blade has its edge located in the corresponding annular slit. The filter rod received in a filter rod-transporting groove is transported with the rotation of the cutting drum and is cut or divided in equal parts when it passes the cutting blades. In this manner, filter plugs, each of which is twice as long as a cigarette filter, are obtained.

The filter plugs, obtained by cutting the filter rod on the cutting drum, are received and carried by a succeeding grooved drum. While they are carried, they are arranged such that their lengthwise directions are perpendicular to the direction in which they are carried. Thereafter, they are supplied to a wrapping machine, which is part of the filter-tipped cigarette manufacturing equipment.

Hitherto, filter-tipped cigarettes of various brand names have been on sale. Since the variety of brand names results from using different kinds of tobacco leaves, changing the mixing rate thereof, or diversifying the packet design, it is expected that filter-tipped cigarettes of new brand names will be on sale in the future by varying the length of cigarette filters.

In order to vary the length of cigarette filters or filter plugs by use of the above-mentioned cigarette filter-manufacturing apparatus, the cutting drum must be replaced with another, and the positions of cutting blades must be adjusted accordingly since the edges of the cutting blades are located within the annular slits of the cutting drum. The replacement of the cutting drum is necessary since the positions of the annular slits have to be changed in accordance with the length of the filter plugs to be manufactured. If the positions of the annular slits are changed, the positions of the cutting blades have to be changed accordingly. Therefore, the replacement of the cutting drum and the adjustment of the positions of the cutting blades are laborious and time-consuming.

A filter rod-manufacturing apparatus presently available is designed to produce filter rods of a prescribed length, e.g., 120 mm. Therefore, if filter plugs shorter than 20 mm are required, a 120 mm-filter rod has to be cut into six equal parts. Conversely, if filter plugs longer than 20 mm are required, the 120 mm-filter rod is usually cut into four equal parts. To cope with these requirements, the above-mentioned replacement of the cutting drum is necessary, and further the cutting blades have to be adjusted in position after determining the appropriate number of cutting blades to be employed. In addition, the filter plug-transporting drums succeeding to the cutting drum have to be modified, as well as their driving mechanisms.

SUMMARY OF THE INVENTION

It is accordingly an object of the present invention to provide an apparatus which can easily change the length of cigarette filters to be manufactured and which is simple is structure and can be adapted for various requirements.

This object is achieved by providing an apparatus which manufactures a plurality of cigarette filter plugs by cutting a cigarette filter rod having a predetermined length and which comprises the following structural components:

cutting means including a cutting drum rotatable in one direction and one rotatable circular cutting blade, the cutting drum having a plurality of filter rod-transporting grooves formed in the circumference of the drum at regular intervals such that the axes of the transporting grooves extend in the same direction as the axis of the cutting drum, and one annular slit formed in the circumference of the cutting drum such that it extends across the transporting grooves, the cutting blade having a circular edge advanced into the annular slit;

filter rod-supplying means for supplying filter rods from a supply position defined in the circumferential direction of the cutting drum into every n-th filter rod-transporting groove (n: a predetermined natural number) of the cutting drum;

a plurality of stoppers located in the respective transporting grooves of the cutting drum and movable in the axial direction of the transporting grooves;

adjusting means for adjusting the distance between each stopper and the annular slit to one second to one ninth of the overall length of a filter rod by moving the stoppers in the axial direction of the transporting grooves in association with one another, whereby the filter rod received in each transporting groove of the cutting drum passes the cutting blade with the rotation of the cutting drum, so that the filter rod is cut into one filter plug whose length is one second to one ninth of the length of the filter rod, and a multiple-length plug whose length is an integral multiple of the filter plug;

pushing means for pushing either the filter rod received in the transporting groove of the cutting drum or the multiple-length plug obtained by cutting the filter rod against the corresponding stopper along the transporting groove, at least when the filter rod or the multiple-length plug is transported from the supply position to the cutting blade position;

receiving means for receiving the filter plug from the transporting groove of the cutting drum, the receiving means including: (a) a receiving drum arranged at a receiving position located away from the supply position in the circumferential direction of the cutting drum and is in rolling contact with the cutting drum such that it is rotatable in the opposite direction to that of the cutting drum, the receiving drum having a plurality of filter plug-receiving grooves which are formed in the circumference thereof at regular intervals and which have axes extending in the same direction as the axis of the receiving drum; and (b) transfer means for transferring, at the receiving position, one or two filter plugs from the transporting groove of the cutting drum to the receiving groove of the receiving drum and for permitting the multiple-length plug to be held in the transporting groove of the cutting drum, in order for the multiple-length plug to be carried again to the cutting blade with the rotation of the cutting drum;

transport means for transporting either the one or two filter plugs received from the receiving groove of the receiving drum; and filter plug-juxtaposing means for juxtaposing the filter plugs which are being transported by the transport means, such that their axes are parallel to one another.

In the above cigarette filter-manufacturing apparatus of the present invention, a filter rod received in a transporting groove of the cutting drum passes the cutting blade, whereby it is cut, as it is transported with the rotation of the cutting drum. Since, at this time, the filter rod is pushed against the stopper, a filter plug cut from the filter rod has a length equal to the distance between the stopper and the annular slit. The filter plug is transferred from the transporting groove of the cutting drum to the receiving groove of the receiving drum, and is then transported. In the meantime, a multiple-length plug, which is the remaining part of the filter rod, is held in the transporting groove and is transported again to the cutting blade. Before the multiple-length plug reaches the cutting blade, it is pushed by the pushing means such that its one end abuts the stopper. When the multiple-length plug passes the cutting blade, a second filter plug is cut from the multiple-length plug. The second filter plug is transferred from the transporting groove of the cutting drum to the receiving groove of the receiving drum, in the same manner as in the first filter plug.

The above-mentioned process of cutting either the filter rod or the multiple-length plug is repeated until the multiple-length plug whose length is twice that of the filter plug is cut into two filter plugs. The two filter plugs, thus obtained, are simultaneously transferred from the transporting groove of the cutting drum to the receiving groove of the receiving drum.

In the case where an original filter rod is twice as long as a filter plug, it is cut into two filter plugs when it passes the cutting blade, and these two filter plugs are simultaneously transferred from the cutting drum to the receiving drum. In this case, therefore, there exist no multiple-length plug which would be transported again to the cutting blade.

In the above-mentioned cigarette filter-manufacturing apparatus, the length of a filter plug is determined by the position of the stopper which is movable in the axial direction of the transporting groove of the cutting drum. Since the distance between the annular slit and the stopper can be adjusted by moving the stopper in the axial direction of the transporting groove, the length of the filter plug can be varied.

An adjusting means for moving the stopper can be easily realized by employing a screw feed mechanism or the like.

When the length of a filter plug to be produced is changed, the length of a filter rod to be supplied to the cutting drum is also changed such that it is an integral multiple of the changed length of the filter plug.

DETAILED DESCRIPTION OF THE PREFERRED EMBODIMENTS

A cigarette filter-manufacturing apparatus according to one embodiment of the present invention will now be described, with reference to FIGS. 1–4.

Figure 4:
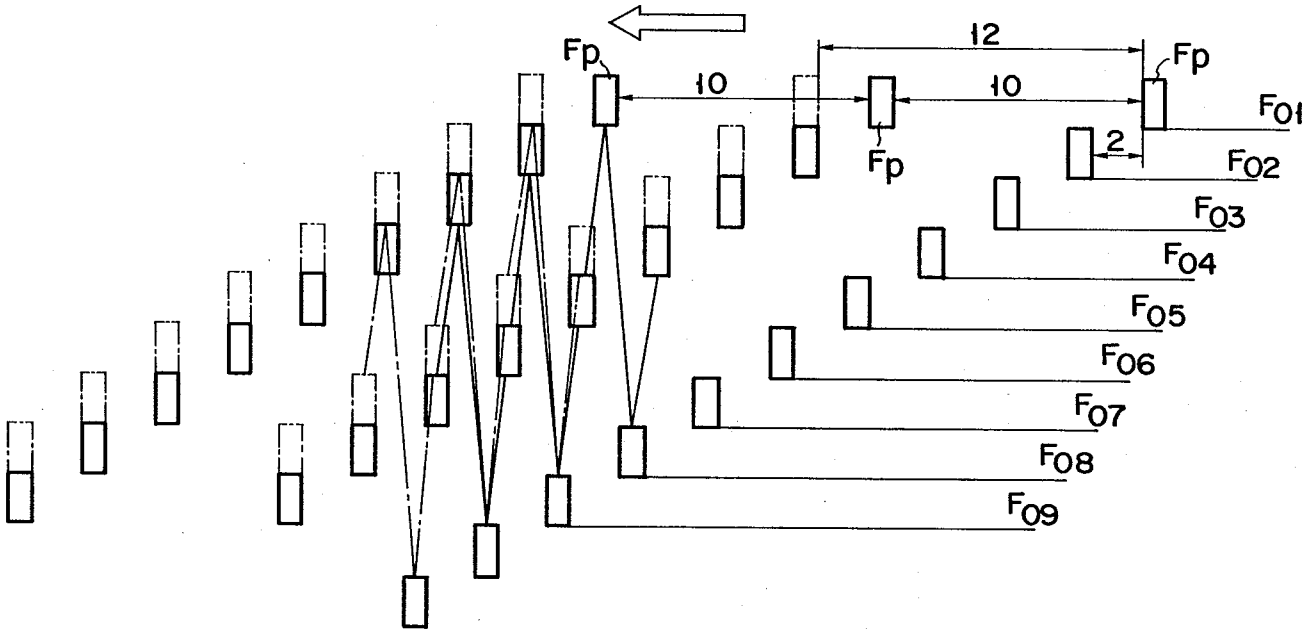
FIG. 4 is an explanatory view illustrating how filter plugs are transported.

As is shown in FIG. 4 the cigarette filter-manufacturing apparatus comprises hopper 2, in which a large number of filter rods F0 are stored. In this embodiment, each filter rod F0 is three times as long as a filter plug to be produced.

Figure 1:
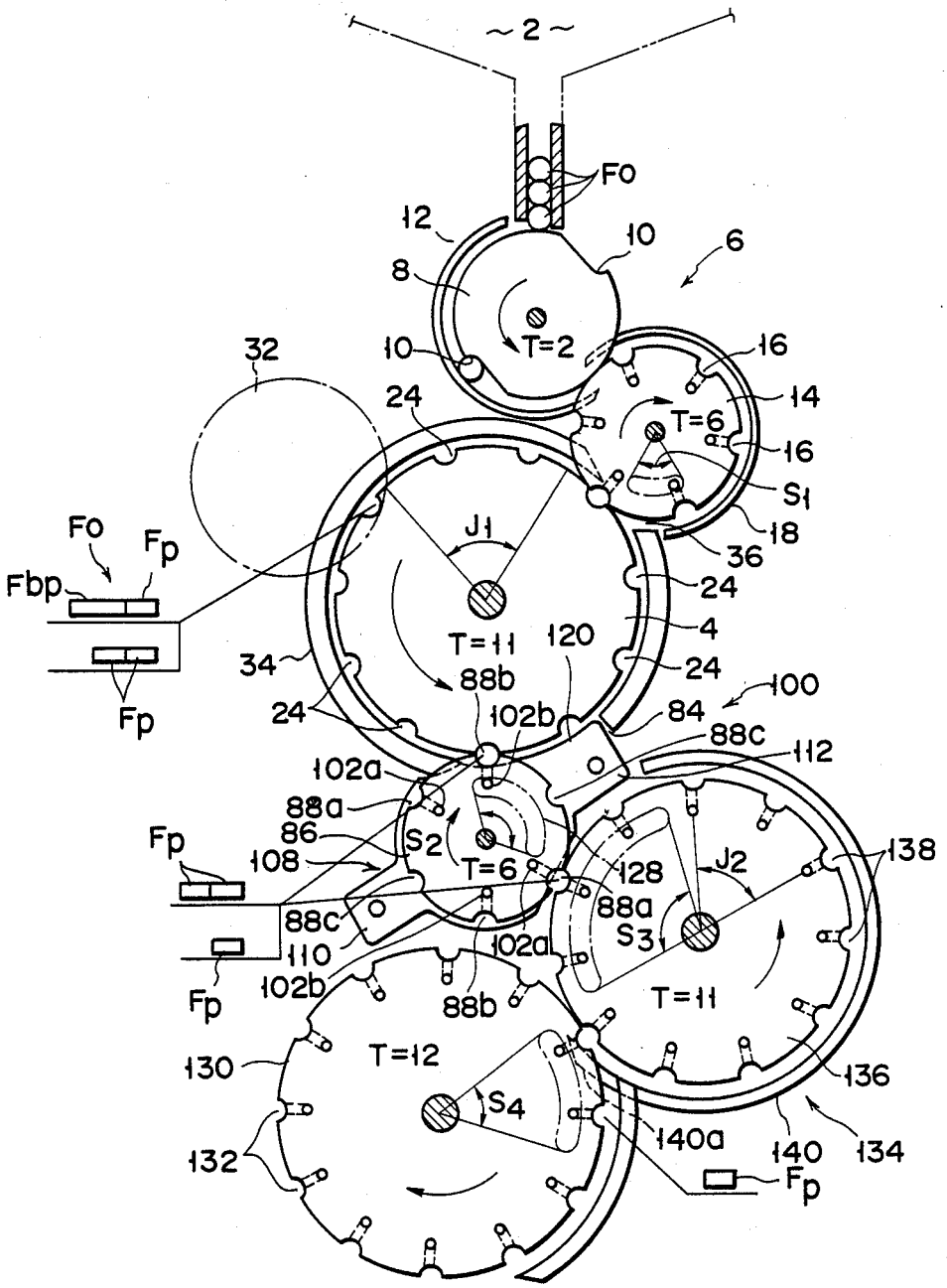
FIG. 1 is a schematic view showing the entire cigarette filter-manufacturing apparatus according to one embodiment of the present invention.

Rotatable cutting drum 4 is provided under hopper 2. Supply mechanism 4 is located between cutting drum 4 and hopper 2, so as to take filter rods F0, one by one, out of hopper 2 and supply them to cutting drum 4. In the case of this embodiment, supply mechanism 6 comprises rotatable take-out drum 8 located right below hopper 2. Take-out drum 8 rotates at a predetermined peripheral speed in the counterclockwise direction, as indicated by the arrow in FIG. 1. Two take-out grooves 10 are formed in the circumference of take-out drum 8 such that they are located at regular intervals in the circumferential direction of take-out drum 8. Since each take-out groove 10 has such a shape as is shown in FIG. 1, it can catch and take one filter rod F0 out of hopper 2. Filter rod F0, taken out of hopper 2 in this manner, is carried with the rotation of take-out drum 8 while being kept in take-out groove 10. Arcuate filter guide 12 is located substantially on the left side of take-out drum 8 such that it extends along the circumference of take-out drum 8. Filter guide 12 serves both to guide filter rod F0, when this filter rod is being carried with the rotation of take-out drum 8, and to prevent the filter rod from dropping from take-out groove 10 of take-out drum 8.

Supply mechanism 6 comprises supply drum 14, in addition to take-out drum 8 mentioned above. Supply drum 14 is located under take-out drum 8 and in rolling contact therewith. Supply drum 14 has the same diameter as that of take-out drum 8, and comprises six supply grooves 16 which are formed in the circumference thereof at regular intervals viewed in the circumferential direction. Each supply groove 16 has a semicircular cross section, the size of which is adapted to receive filter rod F0. Supply drum 14 rotates at the same peripheral speed as that of take-out drum 8 but in the opposite direction. Take-out drum 8 and supply drum 14 rotate such that each take-out groove 10 of drum 8 comes into alignment with a predetermined one of supply grooves 16 of drum 14. More specifically, when drums 8 and 14 rotate, two diametrical supply grooves 16 of drum 14 come into alignment with the respective take-out grooves 10 of drum 8 since, in the embodiment, drums 8 and 14 have the same diameter. When take-out groove 10 comes in alignment with supply groove 16, filter rod F0 is transferred from take-out groove 10 into supply groove 16, and is then carried with the rotation of supply drum 14. In order to guide filter rod F0 which is being transported on supply drum 14, arcuate filter guide 18 is provided substantially on the right side of supply drum 14 such that it extends along the circumference of drum 14, as is shown in FIG. 1.

Figure 2:
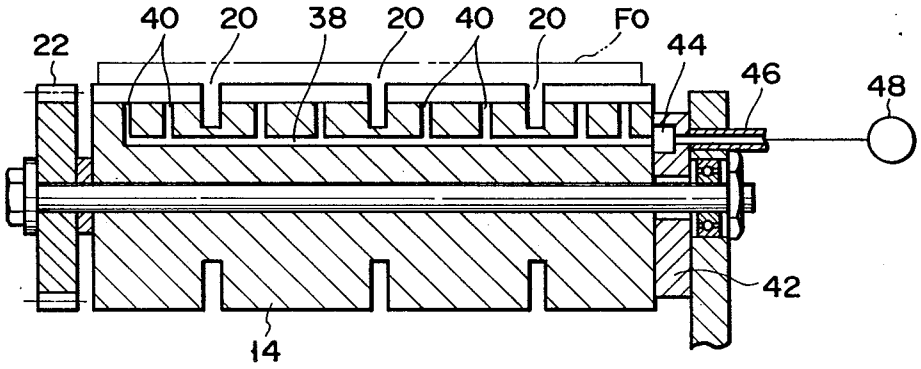
FIG. 2 is a sectional view of a filter rod-supplying drum.

In order to reliably transfer filter rod F0 from take-out groove 10 into supply groove 16, filter guide 12 comprises a forked portion at its lower end, and the prongs (not shown) of the forked portion extend into respective annular depressions 20 (FIG. 2) formed in the circumference of supply drum 14, without preventing rotation of supply drum 14. Likewise, filter guide 18 comprises a forked portion at its upper end, and the prongs (not shown) of the forked portion extend into respective annular depressions (not shown) formed in the circumference of take-out drum 8, without preventing rotation of take-out drum 8. In FIG. 2, reference numeral 22 denotes a gear used for rotating take-out drum 14.

Cutting drum 4 mentioned above is located under supply drum 14 and in rolling contact therewith. Eleven filter rod-transporting grooves 24 are formed in the circumference of cutting drum 4 such that they are arranged in the circumferential direction at the same intervals as those of supply grooves 16 of supply drum 14. Like supply grooves 16, each transporting grooves 16 has a semicircular cross section. Cutting drum 4 rotates in the same peripheral speed as that of supply drum 14, but in the opposite direction. When cutting drum 4 rotates, its transporting grooves 24 comes into alignment with respective supply grooves 16 of supply drum 14. Therefore, when support groove 16 of supply drum 14 comes into alignment with transporting groove 24 of cutting drum 4, filter rod F0 is transferred from supply groove 16 into transporting groove 24, in the same manner in which it is transferred from take-out drum 8 to supply drum 14, and is then transported with the rotation of cutting drum 4.

It should be noted that, when filter rods F0 are transferred from take-out drum 8 to supply drum 14, they are received into every third supply groove 16 of drum 14. In other words, there are two empty supply grooves 16 between two diametric supply grooves 16 in which filter rod F0 is received. Therefore, when filter rods F0 are transferred from supply drum 14 to cutting drum 4, they are received in every third transporting groove 24 of drum 4.

Figure 3:
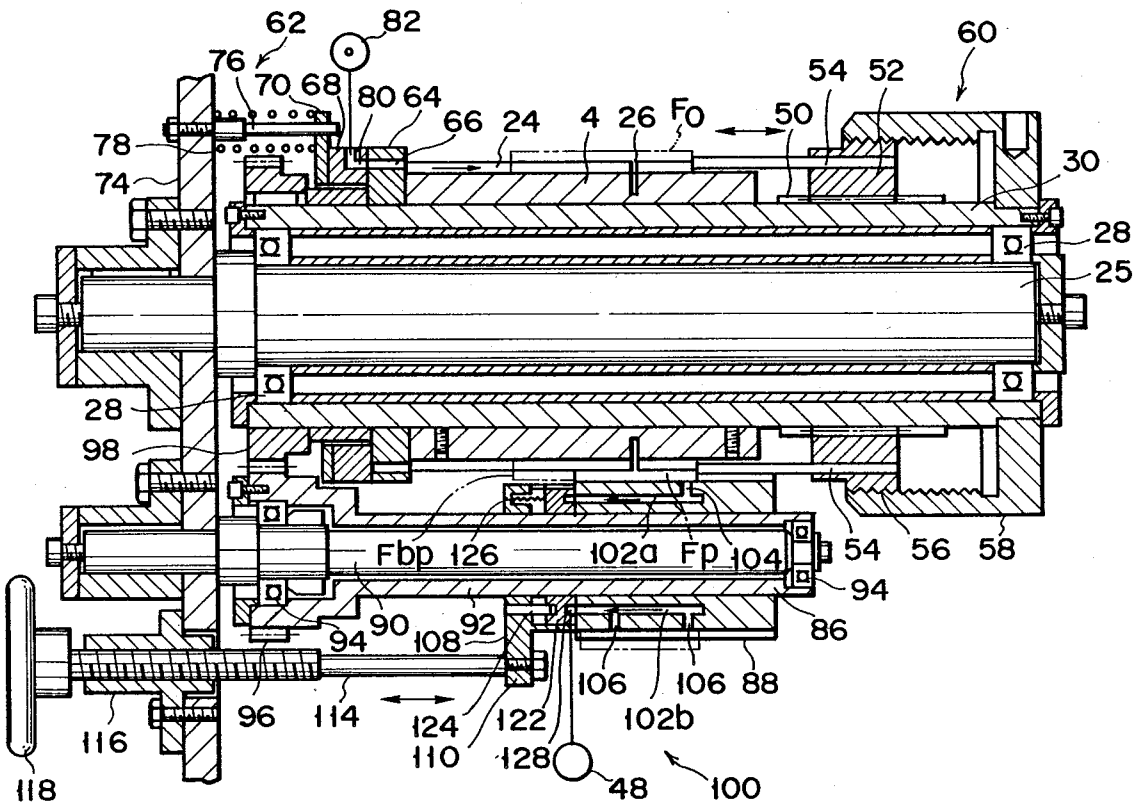
FIG. 3 is a sectional view of both a cutting drum and a receiving drum.

FIG. 3 shows a cross section of cutting drum 4. Cutting drum 4 is rotatable about shaft 25 supported at one end. More specifically, cylinder 30 is rotatably attached to shaft 25 by means of a pair of bearings 28, and cutting drum 4 is fixed to the central portion of rotatable cylinder 30.

In this embodiment, each transporting groove 24 is sufficiently longer than filter rod F0 and extends between the end faces of cutting drum 4, as is clearly shown in FIG. 3.

As indicated by the one-dot-dash lines in FIG. 1, one circular cutting blade 32 is rotatably provided in the vicinity of cutting drum 4. Cutting blade 32 is located downstream of the rolling contact point between cutting drum 4 and supply drum 14 with reference to the direction in which filter rod F0 is transported (the rolling contact point being the filter rod supply position of cutting drum 4). The circular edge of cutting blade 32 extends into the above-mentioned annular slit (26) such that it is deeper than the bottoms of transporting grooves 24.

By cutting blade 32 mentioned above, filter rod F0 received in transporting groove 24 is cut when it is transported with the rotation of cutting drum 4.

Filter guide 34, which is similar in function to filter guides 12 and 18, surrounds substantially the entire circumference of cutting drum 4, and the peripheral portions of cutting blade 32 extends toward cutting drum 4 through a slot (not shown) formed in filter guide 34.

Filter guide 34 is cut away, as is indicated by "36" in FIG. 1, in the neighborhood of the rolling contact point between cutting drum 4 and supply drum 14. Of the two ends of filter guide 34 which define cutaway section 36, that end which is shown as the upper one in FIG. 1 is forked, and the prongs of this forked portion extend into annular depression 20 of supply drum 14, as in the cases of filter guides 12 and 18. On the other hand, that end of filter guide 34 which is shown as the lower one in FIG. 1 is arranged not to interfere with the lower end of filter guide 18. In the embodiment, therefore, filter rod F0 can be transported reliably even at the position where filter guide 18 terminates. As is shown in FIG. 1, suction region S1 is provided in the range in which supply groove 16 moves from the lower end of filter guide 18 to the above-mentioned supply position, and filter rod F0 is held in supply groove 16 by suction when it passes through suction region S1. More specifically, six axially-extending paths 38 are formed in the interior of supply drum 14 such that they are spaced from each other at regular intervals in the circumferential direction of drum 14 and are associated with respective supply grooves 16. Each path 38 communicates with corresponding supply groove 16 by means of a plurality of suction paths 40. As is shown in FIG. 2, one end of path 38 is open in one end face of supply drum 14, and control ring 42 is arranged on the side of the one end face of supply drum 14. Control ring 42 is fixed and is immovable in spite of the rotation of supply drum 14. The end face of supply drum 14 is in sliding contact with the corresponding face of control ring 42. In the face of control ring 42, arcuate suction groove 44 capable of communicating with each path 38 is formed such that its location corresponds to suction region S1. Suction groove 44 is constantly connected to negative pressure source 48 through suction channel 46. Therefore, when supply groove 16 having filter rod F0 therein enters suction region S1 with the rotation of supply drum 14 and path 38 corresponding to that supply groove 16 is connected to suction groove 44 of control ring 42, filter rod F0 in supply groove 16 is sucked due to an air stream and is therefore held in supply groove 16. Therefore, even when filter rod F0 passes through the region where filter guide 18 does not exist, it is held in supply groove 16 by suction, as is shown in FIG. 1, so that it can be transported reliably. Since the suction of filter rod F0 is stopped immediately before supply groove 16 comes into alignment with transporting groove 24 of cutting drum 4, filter rod F0 can be reliably transferred from supply groove 16 into transporting groove 24.

On the outer circumference of rotatable cylinder 30, spline portion 50 is provided such that it is located away from cutting drum 4 by a predetermined distance. Spline ring 52 is provided in engagement with spline portion 50. spline ring 52 rotates with the rotation of cutting drum 4, but it is movable along rotatable cylinder 30, i.e., in the axial direction of cutting drum 4.

Eleven rod-shaped stoppers 54 are attached to the outer peripheral portion of spline ring 52 such that they are arranged at regular intervals in the circumferential direction of spring ring 52. Each stopper 54 extends from the outer peripheral portion of spline ring 42 into corresponding transporting groove 24 of cutting drum 4. In each transporting groove 24, corresponding stopper 54 is movable in the axial direction of groove 24.

Male screw 56 are formed in the outer circumference of spline ring 56, and box nut 58 meshes with male screw 56. Box nut 58 is rotatable with reference to cylinder 30, but is normally rotated together therewith.

Spline portion 50, spline ring 52 and box nut 58 constitutes adjustment mechanism 60 for moving stoppers 54 together in the axial direction of transporting grooves 24. By rotating box nut 58 relative to cylinder 30, spline ring 52 is moved, whereby stoppers 54 are moved together. In this manner, the distance between annular slit 26 and the end of each stopper 54 can be adjusted. In this embodiment, the distance between annular slit 26 and stopper 54 is set to be one third of the overall length of filter rod F0.

Cutting drum 4 comprises pushing mechanism 62 for pushing filter rod F0 received in transporting groove 24 against the tip end of corresponding stopper 54. In the case of this embodiment, pushing mechanism 62 is provided with nozzle ring 64 attached to that end portion of cylinder 30 which is opposite to the end portion where adjustment mechanism 60 is located. Nozzle ring 64 is in contact with the end face of cutting drum 4. Eleven nozzle holes 66 are formed inside nozzle ring 64 such that they are arranged at regular intervals in the circumferential direction of nozzle ring 64. One end of each nozzle hole 66 constantly communicates with corresponding transporting groove 24.

Control ring 68 is provided in contact with that end face of nozzle ring 64 which is farther from cutting drum 4. Control ring 68 is fixed to pressing ring 70, and this pressing ring 70 is movable in the axial direction of cutting drum 4 by means of a plurality of guide rods 76 supported by base plate 74. Guide rods 76 are arranged at regular intervals around the axis of rotatable cylinder 30 though this arrangement is not illustrated. Compression coil spring 78 is wound around each guide rod 76 and is located between base plate 74 and pressing spring 70. Compression coil spring 78 urges pressing ring 70, whereby nozzle ring 64 is pressed with a prescribed pressing force. Like control ring 43 (FIG. 2) mentioned above, control ring 68 is fixed and is thus immovable when nozzle ring 64 is rotated in synchronism with cutting drum 4. Therefore, nozzle ring 64 rotates in sliding contact with control ring 68.

Arcuate air-jetting groove 80 is formed in that end face of control ring 68 which is in sliding contact with nozzle ring 80. Air-jetting groove 80 is so located as to correspond to air-jetting region J1, which is indicated in the illustration of cutting drum in FIG. 1. As can be understood from FIG. 1, air-jetting region J1 is in the range which is, as viewed in the rotating direction of cutting drum 4, between a point immediately after the supply position and a point immediately before the location of cutting blade 32. Air-jetting groove 80 is connected to pressurized air source 82, as is shown in FIG. 3.

The above-mentioned pushing mechanism operates as follows. After transporting groove 24 of cutting drum 4 receives filter rod F0, it is connected to air-jetting groove 80 through nozzle hole 66 of nozzle ring 64, with the rotation of cutting drum 4. As a result, air is jetted from nozzle hole 66 into transporting groove 24 holding filter rod F0. Due to the air jet, filter rod F0 is moved in the axial direction of transporting groove 24 until its end abuts against the tip end of stopper 54. In this manner, filter rod F0 is positioned in transporting groove 24. When filter rod F0 thus positioned passes cutting blade 32, with the rotation of cutting drum 4, it is cut and separated into filter plug Fp (the length of which is ⅓ of the length of filter rod F0) and multiple-length plug Fbp (the length of which is twice that of filter rod F0).

As is shown in FIG. 1, filter guide 34 of cutting drum 4 is cut away not only at "36" but also at "84". This cutaway section (84) is located between cutting blade 32 and supply drum 14, as viewed in the circumferential direction of cutting drum 4.

Filter plug-receiving drum 86 is right below cutting drum 4. Receiving drum 86 is in rolling contact with cutting drum 4 and its upper portion is located in cutaway section 84. Six filter plug-receiving grooves 88 are formed in the circumference of receiving drum 86 such that they are arranged at the same intervals as those of transporting grooves 24 of cutting drum 4. Receiving drum 86 rotates at the same peripheral speed as that of cutting drum 4 but in the opposite direction. When receiving drum 86 rotates, its receiving grooves 88 come into alignment with respective transporting grooves 24 of cutting drum 4.

The sectional construction of receiving drum 86 is shown in FIG. 3. Like the case of cutting drum 4, receiving drum 86 is rotatably attached to fixing shaft 90 (which is supported at one end by base plate 74) by means of rotatable cylinder 92. Shaft 90 extends parallel to shaft 25 of cutting drum 4, and cylinder 92 is rotatably supported with reference to shaft 90 by means of a pair of bearings 94.

Receiving drum 86 is located around one end portion of cylinder 92. When receiving drum 86 rotates, each receiving groove 88 come into alignment with that region of transporting groove 24 in which annular slit 26 is located.

Gears 96 and 98 are provided at those ends of cylinders 92 and 30 which are closer to base plate 74, respectively. Gears 96 and 98 mesh with each other and constitute part of the mechanism which drives both cutting drum 4 and receiving drum 86.

Receiving drum 86 is provided with transfer mechanism 100 for transferring only filter plug Fp from transporting groove 24 of cutting drum 4 into receiving groove 88.

Transfer mechanism 100 has a plurality of axially-extending paths formed inside receiving drum 86. The axially-extending paths include a pair of paths **102*a* and a pair of paths 102*b*. Paths 102*a* are associated with two receiving grooves 88*a* which come in alignment with transporting grooves 24 each holding filter plug Fp and multiple-length plug Fbp, while paths 102*b* are associated with two receiving grooves 88*b* which precede respective receiving grooves 88*a* in the rotating direction of receiving drum 86. As is clear from FIG. 1, two receiving grooves 88*c* and 88*b* exist between a pair of receiving grooves 88*a* since, as noted above, filter rod F0 is supplied from supply drum 14 into every third transporting groove. It should be noted that a pair of receiving grooves 88*b* come into alignment with filter rod-holding transporting groove 24, respectively after this transporting groove 24 passes receiving drum 86** once.

As is shown in FIG. 3, paths **102*a* and paths 102*b* are open in the end face of receiving drum 86 located closer to base plate 74**.

A pair of paths **102*a* communicate with respective associated receiving grooves 88*a* through suction holes 104. Each suction hole 104 is located at such a position that only filter plug Fp is sucked from transporting groove 24. That is, multiple-length plug Fbp is not sucked and remains in transporting groove 24. In short, each suction hole 104 is located on that side of annular slit 26 which is located closer to stopper 54, as viewed in FIG. 3**.

Just like paths **102*a*, a pair of paths 102*b* communicate with respective associated receiving grooves 88*b* through suction holes 106. However, suction holes 106 of paths 102*b* are located, as viewed in FIG. 3, on both sides of annular slit 26**, respectively.

Holder 108 is provided in contact with that end face of receiving drum 86 in which paths **102*a* and 102*b* are open. Holder 108 is slidable with reference to rotatable cylinder 92. As can be understood from FIG. 1, holder 108 is a disk member having a pair of arms 110 and 112 extending in the opposite directions. First and second adjusting rods 114 are coupled, at one end, to arms 110 and 112, respectively. First adjusting rod 114 is parallel to the axis of rotatable cylinder 92 and extends through base plate 74 in a slidable manner, whereby it is supported by base plate 74. Second adjusting rod 114 is parallel to the axis of rotatable cylinder 92 and is threadably inserted into nut member 116 fixed to base plate 74. Second adjusting rod 114 is projected from nut member 116, and handle 118 is coupled to this projected end. By turning handle 118, both adjusting rods 114 are moved in their axial direction, so that holder 108 is moved along rotatable cylinder 92**.

As is shown in FIG. 1, one side of arm 112 and the other periphery of holder 108 continuous to that one side of arm 120 are formed as constituting guide face 120, by which cutaway section 84 of filter guide 34 is compensated for.

A circular depression is formed in that end face of holder 108 which faces receiving drum 86, and control ring 122 is arranged in that depression. Control ring 122 is prevented from rotating by stopper pin 124, but can be moved in the axial direction of cylinder 92. Compression spring 126 is arranged inside the depression, and control ring 122 is pressed against the end face of receiving drum by the urging force of compression spring 126. That is, receiving drum 86 rotates in sliding contact with control ring 122.

Arcuate suction groove 128 is formed in that end face of control ring 122 which is in sliding contact with receiving drum 86. Suction groove 128 is located such that it can communicate with the open ends of axially-extending paths **102*a* and 102*b* and that it falls within suction region S2 indicated in FIG. 1. The angle of suction region S2 is predetermined, as viewed in the rotating direction of receiving drum 86, with reference to the rolling contact point between cutting drum 4 and receiving drum 86. Suction groove 128 is constantly connected to pressure source 48** mentioned above.

Transfer mechanism 100 mentioned above operates as follows. When transporting groove 86 holding both filter plug Fp and multiple-length plug Fbp comes into engagement with receiving groove 88of receiving drum 86, only filter plug Fp is sucked due to the suction in suction hole 104 (which is connected to negative pressure source 48 through path **102*a* and suction groove 128) and is therefore transferred from transporting groove 86 into receiving groove 88*a*. However, multiple-length plug Fbp remains in transporting groove 24 and is transported again to cutting blade 32. When multiple-length plug Fbp enters air-jetting region J1 of pushing mechanism 62, it is moved along transporting groove 24 for the distance corresponding to the length of filter plug Fp and abuts against stopper 54. In this condition, multiple-length plug Fbp passes cutting blade 32**, whereby it is cut into two filter plugs Fp. One of these two filter plugs Fp is carried in the same way as the above-mentioned transferred filter plug is carried.

When transporting groove 24 holding two filter plugs Fp mentioned above comes into alignment with receiving groove **88*b* of receiving drum 86, the two filter plugs are transferred together from transporting groove 24 into receiving groove 88*b* since, at this time, the two suction holes 106 of receiving groove 88*b* are connected to negative pressure source 48 through axially-extending path 102*b* and suction groove 128**.

When multiple-length plug Fbp is transported to cutting blade 32, transporting groove 24 which holds multiple-length plug Fbp passes supply drum 14. At this time, however, no new filter rod F0 is supplied to that transporting groove 24 since supply drum 14 supplies filter rod F0 into every third transporting groove and the number of transporting grooves 24 is set to be eleven, as noted above.

As is shown in FIG. 1, filter plug-juxtaposing drum 130 is located under receiving drum 86. This juxtaposing drum has a plurality of filter plug-juxtaposing grooves (e.g., twelve filter plug-juxtaposing grooves) 132 formed in the circumference thereof such that they are arranged at the same intervals as those of transporting grooves 24 or receiving grooves 88.

Filter plug-juxtaposing mechanism 134 is located between receiving drum 86 and juxtaposing drum 130. Juxtaposing mechanism 134 receives filter plug Fp from drum 86 and transfers it to juxtaposing drum 130. Juxtaposing mechanism 134 also serves to juxtapose filter plugs Fp when it carries them. In this embodiment, juxtaposing mechanism 134 is constituted by filter plug-bypassing drum 136 which is in rolling contact with both receiving drum 86 and juxtaposing drum 130. In the circumference of bypassing drum 136, eleven filter plug-bypassing grooves 138 are formed such that they are arranged at the same intervals as those of receiving grooves 88 and juxtaposing grooves 138.

Bypassing drum 136 rotates at the same peripheral speed as that of receiving drum 86 but in the opposite direction. Likewise, juxtaposing drum 130 rotates at the same peripheral speed as that of bypassing drum 136 but in the opposite direction. Therefore, bypassing drum 136 rotates in such a manner that its bypassing groove 138 comes with alignment with both one receiving groove 88 of drum 86 and one alignment groove 132 of drum 130.

The rolling contact point between bypassing drum 136 and receiving drum 86 is located downstream of suction region S2, as viewed in the rotating direction of receiving drum 86.

Filter guide 140, which is similar in function to the above-mentioned filter guides, extends along the right circumferential region, as viewed in FIG. 1, of bypassing drum 136. The upper end of filter guide 140 is located immediately before arm 112 of holder 108, so as to prevent filter guide 140 from interfering with arm 112, while the lower end thereof is forked and enters the region of juxtaposing drum 130 without preventing rotation of drum 130.

Bypassing drum 136 has suction region S3 which is similar to suction regions S1 and S2 mentioned above. Suction region S3 extends from the upper end of filter guide 140, passes the rolling contact point between bypassing drum 136 and receiving drum 86, and ends at a point immediately before the rolling contact point between bypassing drum 136 and juxtaposing drum 130. Juxtaposing drum 130 also has suction region S4. The angle of suction region S4 is predetermined, as viewed in the rotating direction of juxtaposing drum 130, with reference to the rolling contact point between juxtaposing drum 130 and bypassing drum 136. Although not illustrated in the drawings, the constructions of suction regions S3 and S4 are similar to those of suction regions S1 and S2 in this embodiment.

A description will be given as to how the above-mentioned bypassing drum and suction regions S3 and S4 operate. When either groove 88*a* or groove 88*b* of receiving drum 86 comes into alignment with bypassing groove 138 of bypassing groove 136, one or two filter plugs Fp are reliably transferred from groove 88*a* or 88*b* into bypassing groove 138, due to the suction effect in suction region S3. Although there is no filter guide from the rolling contact point between drums 4 and 86 to the rolling contact point between drums 86 and 136, filter plug or plugs Fp are reliably held in receiving groove 88*a* or 88*b*, due to the suction effect in suction region S2.

After transferred into bypassing groove 138 of bypassing drum 136, filter plug of plugs Fp are carried with the rotation of drum 138. When groove 138 of drum 136 comes into alignment with juxtaposing groove 132 of juxtaposing groove 132, filter plug or plugs Fp are transferred from groove 138 into groove 132. It should be noted that this transfer operation is performed in different manners between the case where one filter plug Fp is transferred and the case where two filter plugs Fp are transferred.

In the case where only one filter plug Fp is held in bypassing groove 138 of bypassing drum 136, it is transferred into juxtaposing groove 132 when groove 138 comes into alignment with groove 132. In contrast to this, in the case where two filter plugs Fp are held in bypassing groove 138, one of them is transferred into juxtaposing groove 132, while the other is left in bypassing groove 138 and is transported with the rotation of bypassing drum 136.

The transportation of the second filter plug (i.e., the filter plug to be left in bypassing groove 138) is performed by means of filter guide 140 of bypassing drum 136. As mentioned above, the lower end of filter guide 140 is forked. Prongs 140*a* of this forked portion are so arranged as to cause the second filter plug to be kept in bypassing groove 138, in spite of the suction effect in suction region S4 of juxtaposing drum 130.

Therefore, the second filter plug is kept in bypassing groove 138 and is transported, once more, with the rotation of bypassing drum 136. When it passes suction region J2 shown in FIG. 1, it is moved along groove 138 by the jetted air and is therefore positioned at the same location as the first filter plug (i.e., the filter plug already transferred into juxtaposing groove 132) was positioned. Although not illustrated, the construction of suction region J2 is similar to the above-mentioned construction of suction region J1 of cutting drum 4. Each bypassing groove 138 of bypassing drum 136 has a stopper which is either fixed or has a similar function to stopper 54 of air-jetting region J1. Due to the cooperation between such a stopper and suction region J2, filter plug Fp is positioned in each bypassing groove in the above-noted manner.

When bypassing groove 138 holding the second filter plug Fp comes into alignment with juxtaposing groove 132 of juxtaposing drum 138 once again, the second filter plug is transferred from groove 138 into groove 132. As mentioned above, bypassing drum 136 has eleven bypassing grooves 138. Therefore, when the second filter is transported once more, bypassing groove 138 holding the second filter plug comes into alignment with receiving groove 88*c* of receiving drum 86, not with receiving groove 88*a* or 88*b*. As a result, bypassing groove 138 holding the second filter plug does not receive one or two new filter plugs Fp from drum 86.

As can be understood from the above description, three filter plugs Fp obtained from one filter rod F0 are eventually supplied to juxtaposing grooves 132 of juxtaposing drum 130. At this time, the second filter plug is supplied into the eleventh juxtaposing groove with reference to the juxtaposing groove of the first filter plug (i.e., there are ten grooves between the groove of the first filter plug and the groove of the second filter plug). Likewise, the third filter plug is supplied into the eleventh juxtaposing groove with reference to the juxtaposing groove of the second filter plug (i.e., there are ten grooves between the groove of the second filter plug and the groove of the third filter plug). More specifically, filter plug Fp and multiple-length plug Fbp obtained from one and the same filter rod F0 are transported such that multiple-length plug Fbp is delayed from filter plug Fp by the distance corresponding to eleven transporting grooves 24 of cutting drum 4. This is because the number of grooves 24 of cutting drum 4 is set to be eleven, as mentioned above. Further, two filter plugs Fp obtained from the same multiple-length plug are transported such that one precedes the other by the distance corresponding to eleven bypassing grooves 138 of bypassing drum 136. This is because the number of grooves 138 of bypassing drum 136 is set to be eleven, as mentioned above.

FIG. 4 shows how three filter plugs Fp obtained from one filter rod are transported. In FIG. 4, reference symbol $F0_1$ denotes the filter rod which is supplied to cutting drum 4 first of all. FIG. 4 also shows how three filter plugs Fp of each succeeding filter rod ($F0_2$, $F0_3$, . . . ) are transported. Each succeeding filter rod is supplied to cutting drum 4 such that one delays from its preceding one by the distance corresponding to three transporting grooves 24, that is, there are two transporting grooves between the two transporting grooves which receive a filter rod. As can be understood from FIG. 4, three filter plugs Fp obtained from one filter rod $F0_n$ (n: a natural number) are followed by the respective filter plugs Fp obtained from succeeding filter rod $F0_{n+1}$ by the distance corresponding to three grooves. As a result, filter plugs Fp are successively supplied into juxtaposing grooves 132 of juxtaposing drum 130, as is indicated by the solid lines in FIG. 4, at least after the last one of three filter plugs Fp obtained from filter rod $F0_1$ is supplied to juxtaposing drum 130. Therefore, in the transportation path provided following juxtaposing drum 130 (i.e., the transportation path leading to a wrapping machine wherein two cigarettes and one filter plug are connected together), filter plugs Fp are transported successively.

In FIG. 1, "T" indicated in the illustration of each drum represents the number of grooves. Further, the cut condition of a filter rod or a multiple-length plug is also indicated at some points of the transportation path shown in FIG. 1.

The present invention is not limited to the embodiment mentioned above; it can be modified in various manners in accordance with the need. For instance, adjustment mechanism 60 for moving each stopper is not limited to the screw type mentioned with respect to the above embodiment. Further, pushing mechanism 62 and transfer mechanism 100 do not have to utilize jetted air or suction air; they may be designed as mechanical means which employ transportation guides.

Moreover, the number of grooves of cutting drum 4 or bypassing drum 136 need not be eleven. Even when that number is set to be thirteen, successive transportation of filter plugs Fp on juxtaposing drum 130 is achieved, as in the above embodiment. The manner in which filter plugs Fp are transported when cutting drum 4 and bypassing drum 130 each have thirteen grooves is indicated by the one-dot-dash lines in FIG. 4. In this case, three filter plugs Fp obtained from each filter rod are transported such that one delays from another by the distance corresponding to thirteen grooves (i.e., there are twelve grooves between the two grooves in which two successive filter plugs are held), and filter plugs Fp are successively supplied into juxtaposing grooves 132 of juxtaposing drum 130, as is indicated by the one-dot-dash lines in FIG. 4.

Figure 5:
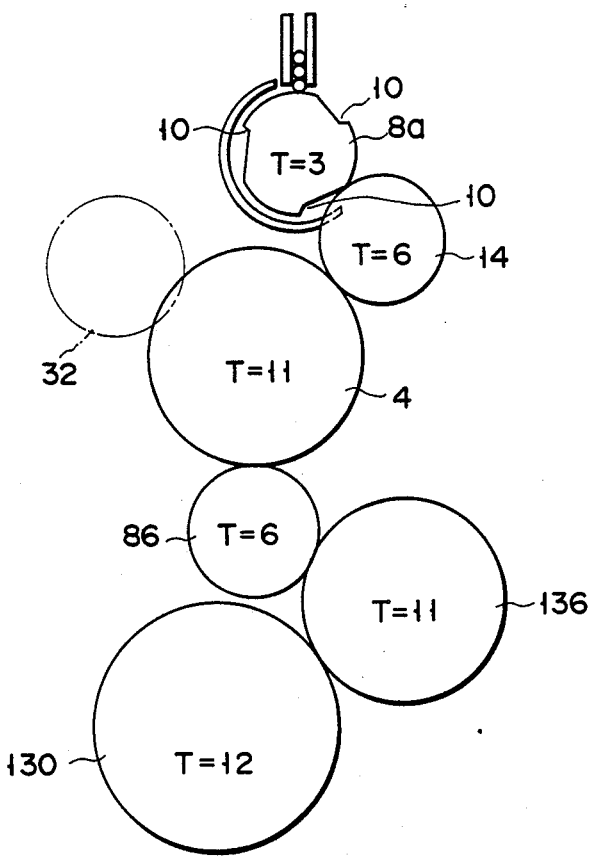
FIG. 5 is a schematic view showing a cigarette filter-manufacturing apparatus according to another embodiment of the present invention.

The above embodiment was explained with reference to the case where one filter rod is cut into three equal parts. However, the apparatus of the present invention can be adapted for handling filter rod F0 which is twice as long as filter plug Fp. An apparatus, thus adapted, is schematically illustrated in FIG. 5. The apparatus illustrated in FIG. 5 is similar to that illustrated in FIG. 1, except for the construction of the take-out drum. Specifically, take-out drum **8*a* of the apparatus shown in FIG. 5 comprises three take-out grooves 10, and filter rod F0 is supplied into every second groove of supplying drum 14, i.e., into every second transporting groove 24 of cutting drum 4. Since filter rod F0 handled by the apparatus in FIG. 5 is twice as long as filter plug Fp, it is an equivalent of multiple-length plug Fbp mentioned in the above embodiment. Once it is cut with cutting blade 32, it is divided into two filter plugs Fp, so that no multiple-length plug Fbp is transported on cutting drum 4 in the case of the apparatus shown in FIG. 5**.

Figure 6:
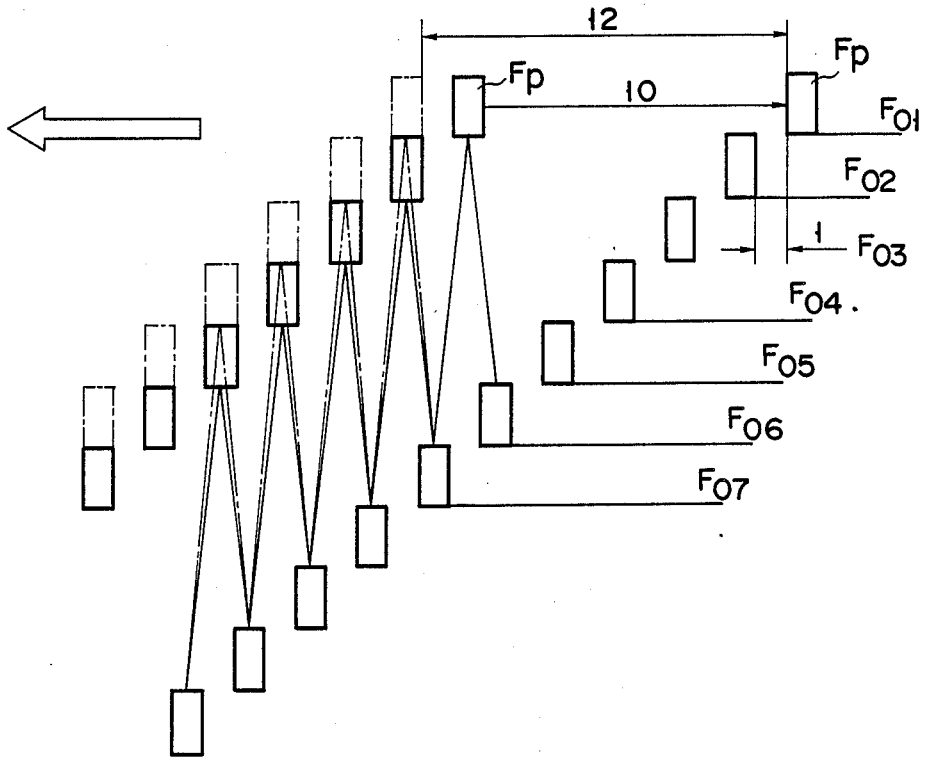
FIG. 6 is an explanatory view illustrating how filter plugs are transported in the apparatus shown in FIG. 5.

FIG. 6 shows how filter plugs Fp are transported in the case of the apparatus illustrated in FIG. 5. As is indicated by the solid lines in FIG. 6, filter plugs Fp are eventually transported in succession. The one-dot-dash lines in FIG. 6 indicate how filter plugs Fp are transported in the case where cutting drum 4 and bypassing drum 136 of the apparatus shown in FIG. 5 each comprise thirteen grooves. In this case as well, filter plugs Fp are eventually transported in succession.

As is apparent from the comparison between the embodiments shown in FIGS. 1 and 5, the apparatus of the present invention can change the number of filter plugs obtained from one filter rod by merely replacing the take-out drum with a proper one. The other drums need not be modified in accordance with this change.

In the embodiments mentioned above, filter plugs are eventually supplied in succession. However, the apparatus of the present invention can be adapted such that filter plug Fp is supplied into every second juxtaposing groove 132 of juxtaposing drum 130, to thereby achieve the intermittent transportation of filter plugs Fp illustrated in FIG. 7. The construction for achieving this intermittent transportation differs from the construction of the embodiment shown in FIG. 1, in that cutting drum 4 and bypassing drum 136 each comprise ten grooves and that take-out drum 8 comprises only one take-out groove 10.

Figure 7:
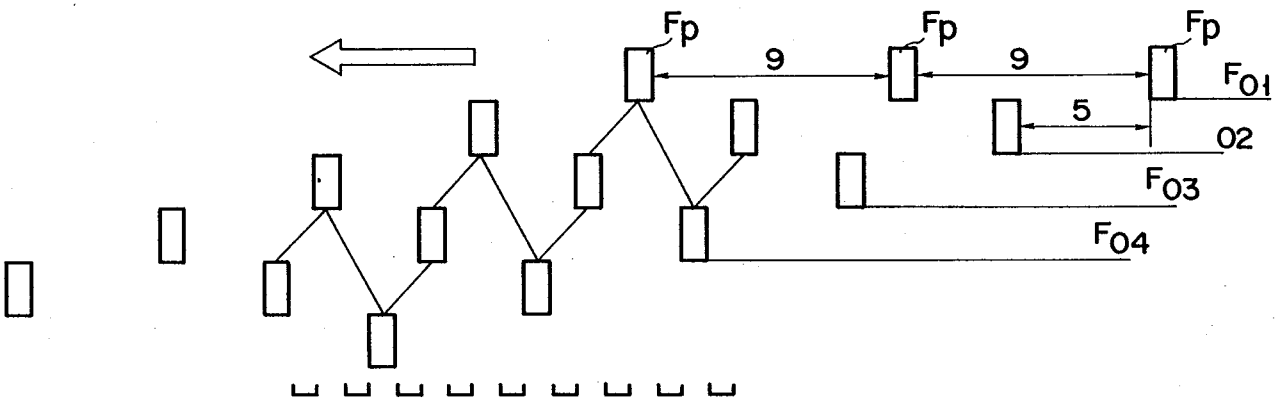
FIG. 7 is an explanatory view illustrating an alternative manner in which the filter plugs are transported.
Figure 8:
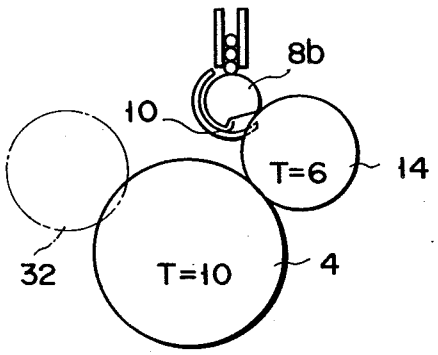
FIG. 8 is a schematic view showing a modification of part of apparatus.
Figure 9:
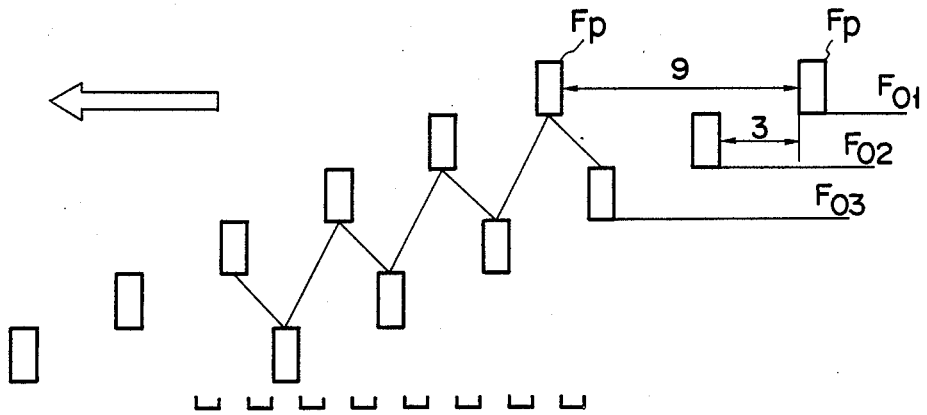
FIG. 9 an explanatory view illustrating how filter plugs are transported as a result of the modification shown in FIG. 8.

The intermittent transportation shown in FIG. 7 corresponds to the case where one filter rod F0 is cut into three filter plugs Fp. If it is intended that one filter rod F0 be divided into two filter plugs Fp, then take-out drum **8*b* illustrated in FIG. 8 is employed. This take-out drum 8*b* has only one take-out groove 10, as in the case shown in FIG. 7, but has a diameter different from that of supplying drum 14. Specifically, the diameter of take-out drum 8*b* is determined such that four supplying grooves 16 can be formed in the circumference of supplying drum 14 at the same intervals as those of supplying grooves 16 in the case of FIG. 7**.

Figure 10:
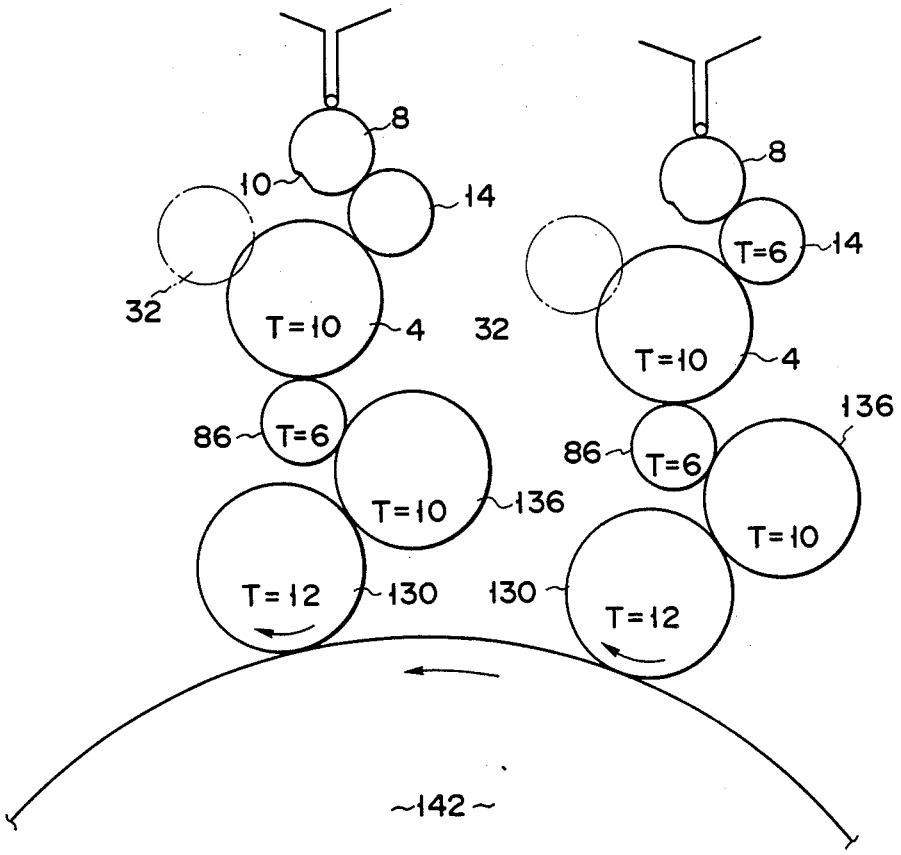
FIG. 10 is a schematic view showing an example of a construction in which two cigarette filter-manufacturing apparatuses are combined.
Figure 11:
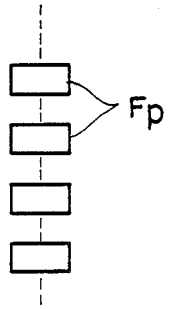
FIG. 11 is an explanatory view illustrating how filter plugs obtained by the construction shown in FIG. 10 are transported.

Usually, the above-mentioned apparatus for achieving intermittent transportation of filter plugs Fp is not used singly; a pair of such apparatuses are combined in practice, as is shown in FIG. 10. As is apparent from this Figure, each filter-manufacturing apparatus is of a type which produces the intermittent transportation of filter plugs Fp shown in FIG. 7, and juxtaposing drum 130 of each apparatus is in rolling contact with common large-diameter grooved drum 142. In the circumference of this grooved drum, filter plug-arranging grooves (not shown) are formed at the same intervals as those of juxtaposing grooves 132 of each juxtaposing drum 130. Grooved drum 142 rotates at the same peripheral speed as that of each juxtaposing drum 130. Filter plug Fp is supplied from juxtaposing drum 130 of each apparatus into every second groove of drum 142. Therefore, successive transportation of filter plugs Fp can be produced, as is shown in FIG. 11, by locating juxtaposing drum 130 of one apparatus such that it supplies filter plug Fp into those arranging grooves which do not receive filter plugs Fp from juxtaposing drum 130 of the other apparatus. The construction shown in FIG. 10 is suitable for a wrapping machine which produces filter-tipped cigarettes at a high speed.

Figure 13:
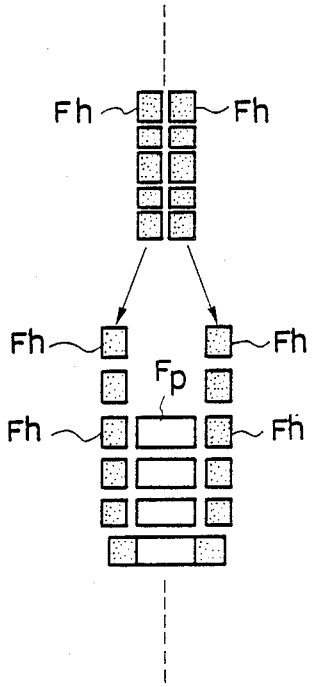
FIG. 13 is an explanatory view illustrating how filter plugs obtained by the construction shown in FIG. 12 are transported.
Figure 12:
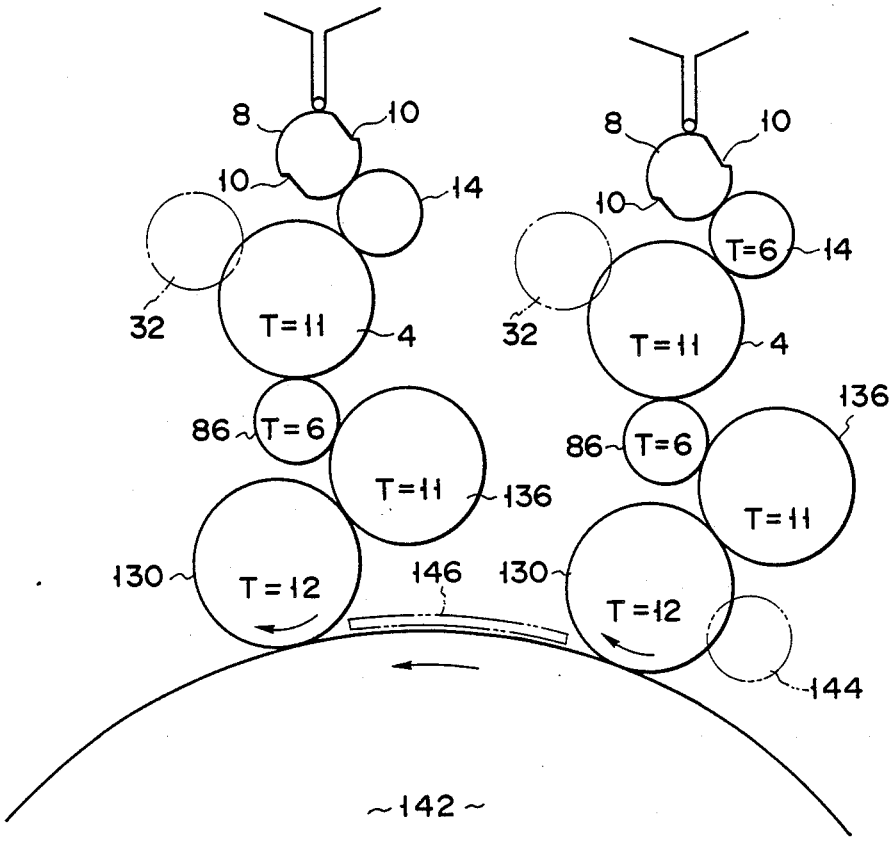
FIG. 12 is a schematic view showing another example of a construction in which two cigarette filter-manufacturing apparatuses are combined.

To obtain a construction for producing dual filter plugs, two filter-manufacturing apparatuses of FIG. 1 are combined, as is shown in FIG. 12. Dual filter plugs can be easily manufactured by supplying charcoal filter plugs from the apparatus illustrated on the right side of FIG. 12 and supplying plain filter plugs from the other apparatus. In the apparatus processing charcoal filter plugs, cutting blade 144 is provided for juxtaposing drum 130, so as to cut a charcoal filter plug into two half-length plugs Fh. These two half-length plugs are supplied into the same arranging groove of drum 142 simultaneously. The two half-length plugs are separated from each other by a predetermined gap when they are being conveyed toward the other apparatus. Such a gap can be easily produced by providing separation guide 146 on the circumference of grooved drum 142. By supplying plain filter plug Fp between two half-length plugs Fh, as is shown in FIG. 13, a dual filter plug is obtained.

The above embodiments were explained, referring to the case where one filter rod is cut into two or three equal parts. However, one filter rod can be cut into a desirable number of parts in accordance with the need, and the number of grooves of each drum is determined on the basis of the number of parts obtained from one filter rod.

In the above embodiments, juxtaposing mechanism 134 is constituted by bypassing drum 136. However, filter plugs Fp can be juxtaposed by use of a known transportation drum which carriers filter plugs with a certain time delay.

According to the filter-manufacturing apparatus of the present invention, the position of the stopper in each transporting groove of the cutting drum can be adjusted by the stopper adjusting mechanism. Therefore, the distance between the stopper and the annular slit of the cutting drum can be adjusted, so as to obtain filter plugs of a desirable length from one filter rod. As a result, filter plugs of various sizes can be produced, without replacing the cutting drum or cutting blade and without adjustment which may be required after such replacement. In addition, since the stopper-adjusting mechanism is simple in construction, the entire apparatus is not complex. Further, the number of equal parts obtained from one filter rod can be easily changed with no need to replace a number of drums.

What is claimed is:

1. An apparatus for manufacturing a plurality of cigarette filter plugs by cutting a cigarette filter rod, comprising:

cutting means including:

a cutting drum rotatable in one direction, said cutting drum having a plurality of transporting grooves adapted to receive filter rods therein and formed in a circumference of the cutting drum at regular intervals such that axes of the transporting grooves extend in the same direction as an axis of the cutting drum, said cutting drum also having one annular slit formed in the circumference of the cutting drum such that the annular slit extends across the transporting grooves; and one rotatable circular cutting blade, said cutting blade having a circular edge extending into the annular slit;

filter rod-supplying means for supplying filter rods, each of which is a few times as long as the filter plug, from a supply position, defined with reference to a circumferential direction of the cutting drum, into every n-th transporting groove of the cutting drum (n: a predetermined natural number);

a plurality of stoppers located in the respective transporting grooves of the cutting drum and movable in unison in an axial direction of the transporting grooves;

adjusting means for adjusting the distance between each stopper and the annular slit to a distance corresponding to the length of one filter plug by moving all the stoppers together in the axial direction of the transporting grooves in association with one another, whereby the filter rod received in each transporting groove of the cutting drum passes the cutting blade with the rotation of the cutting drum, so that the filter rod is cut into one filter plug and a multiple-length plug whose length is an integral multiple of that of the filter plug;

pushing means for pushing either the filter rod received in the transporting groove of the cutting drum or the multiple-length plug obtained by cutting the filter rod against the corresponding stopper along the transporting groove, at least when the filter rod or the multiple-length plug is transported from the supply position to the cutting blade;

receiving means for receiving the filter plug from the transporting groove of the cutting drum, said receiving means including:

a receiving drum which is arranged at a receiving position located away from the supply position in the circumferential direction of the cutting drum and is adapted to be in rolling contact with the cutting drum such that the receiving drum is rotatable in the opposite direction to that of the cutting drum, said receiving drum having a plurality of receiving grooves which are formed in the circumference of the receiving drum at regular intervals and adapted to receive filter plugs and which have axes extending in the same direction as an axis of the receiving drum; and transfer means for transferring, at the receiving position, one or two filter plugs from the transporting groove of the cutting drum to the receiving groove of the receiving drum and for permitting the multiple-length plug to be held in the transporting groove of the cutting drum, in order for the multiple-length plug to be transported again to the cutting blade with the rotation of the cutting drum, transport means for transporting either the one or two filter plugs received from the receiving groove of the receiving drum; and filter plug-juxtaposing means for juxtaposing the filter plugs transported by the transport means, such that their axes are parallel to one another.

2. An apparatus according to claim 1, wherein:

each transporting groove of the cutting drum is open at least in one end face of the cutting drum;

each stopper has a first end extending along the corresponding transporting groove toward the annular slit and a second end projected from the end face of the cutting drum; and said adjusting means includes: (a) a holding member, located on the side of the end face of the cutting drum, for supporting the second ends of the stopper, said holding member being rotatable together with the cutting drum and being movable in an axial direction of the cutting drum; and (b) moving means for moving the holding member in the axial direction of the cutting drum.

3. An apparatus according to claim 2, wherein:

said holding member includes a disk coaxially arranged with the cutting drum; and said moving means includes a screwed portion formed in an outer circumference of the holding member, and a nut member threadably fitted around the screw portion and permitting the holding member to move in the axial direction of the cutting drum.

4. An apparatus according to claim 3, wherein:

said cutting drum includes a fixing shaft coaxially projecting from the end face of the cutting drum and having a spline portion on an outer periphery thereof;

said disk is in engagement with the spline portion of the fixing shaft; and said nut member is mounted on the fixing shaft and is rotatable with reference to said cutting drum.

5. An apparatus according to claim 1, wherein:

each transporting groove of said cutting drum has an open end which is located opposite to the corresponding stopper and is open in a second end face of the cutting drum; and said pushing means includes air-jetting means for jetting air from the open end of each transporting groove toward the corresponding stopper.

6. An apparatus according to claim 1, wherein said transfer means includes suction means for permitting only the filter plug, obtained by cutting the filter rod in the transporting groove, to be transferred from the transporting groove into the receiving groove of the receiving drum.

7. An apparatus according to claim 6, wherein said suction means includes:

at least one suction hole for sucking only the filter plug, said one suction hole being open in bottoms of those receiving grooves which, with rotations of both the cutting drum and receiving drum, come into alignment with transporting grooves holding both the filter plug and the multiple-length plug; and a negative pressure source for sucking air from the suction hole.

* * * * *

UNITED STATES PATENT AND TRADEMARK OFFICE

CERTIFICATE OF CORRECTION

PATENT NO. : 4,943,272

DATED : July 24, 1990

INVENTOR(S) : Ichiro Hirose, et al

It is certified that error appears in the above-identified patent and that said Letters Patent is hereby corrected as shown below:

On the title page:

Section [30] " Foreign Application Priority Data
Nov. 18, 1987 [JP] Japan .....62-289538"

should be deleted in its entirety.

Signed and Sealed this

Third Day of March, 1992

*Attest:*

HARRY F. MANBECK, JR.

*Attesting Officer*

*Commissioner of Patents and Trademarks*